US007955199B2

(12) United States Patent
Tucker, Jr. et al.

(10) Patent No.: US 7,955,199 B2
(45) Date of Patent: Jun. 7, 2011

(54) LACROSSE HEAD HAVING A GROOVED FRAME MEMBER AND INDEPENDENT STOP

(75) Inventors: Richard B. C. Tucker, Jr., Baltimore, MD (US); David Reeb, Columbia, MD (US)

(73) Assignee: WM. T. Burnett IP, LLC, Baltimore, MD (US)

( * ) Notice: Subject to any disclaimer, the term of this patent is extended or adjusted under 35 U.S.C. 154(b) by 0 days.

(21) Appl. No.: 12/764,567

(22) Filed: Apr. 21, 2010

(65) Prior Publication Data

US 2010/0267501 A1 Oct. 21, 2010

Related U.S. Application Data

(62) Division of application No. 11/414,212, filed on May 1, 2006, now Pat. No. 7,736,252.

(60) Provisional application No. 60/676,312, filed on May 2, 2005.

(51) Int. Cl.
*A63B 59/02* (2006.01)
*A63B 65/12* (2006.01)

(52) U.S. Cl. ..... 473/513; D21/724

(58) Field of Classification Search ..... 473/513, 473/512, 505; D21/724
See application file for complete search history.

(56) References Cited

U.S. PATENT DOCUMENTS 3,507,495 A * 4/1970 Fracalossi et al. ..... 473/513
3,822,062 A * 7/1974 Tucker et al. ..... 473/513
4,034,984 A * 7/1977 Crawford et al. ..... 473/513
4,037,841 A * 7/1977 Lewis, Jr. ..... 473/513
4,097,046 A 6/1978 Friant
4,138,111 A 2/1979 Rule
4,153,251 A * 5/1979 Pond ..... 473/513
D252,167 S 6/1979 Ahlenfeld et al.
4,270,756 A * 6/1981 Ahlenfeld et al. ..... 473/513
4,358,117 A 11/1982 Deutsch
4,460,178 A 7/1984 Ulman
D286,666 S 11/1986 Brine, Jr.
D286,803 S 11/1986 Brine, Jr.
D297,963 S 10/1988 Tucker et al.
5,035,434 A 7/1991 Taylor et al.
5,037,112 A 8/1991 Brine, III et al.
5,048,843 A 9/1991 Dorfi et al.
5,054,790 A 10/1991 Brine, III et al.
5,067,726 A 11/1991 Brine, III et al.
5,080,372 A 1/1992 Brine, III et al.
D331,086 S 11/1992 Brine, III et al.
5,178,397 A 1/1993 Brine, Jr.
D350,174 S 8/1994 Tucker et al.
5,494,297 A 2/1996 MacNeil
5,566,947 A 10/1996 Tucker et al.
5,568,925 A * 10/1996 Morrow et al. ..... 473/513
5,651,549 A 7/1997 Dill et al.
(Continued)

*Primary Examiner* — Gene Kim
*Assistant Examiner* — M Chambers
(74) *Attorney, Agent, or Firm* — Ober, Kaler, Grimes & Shriver; Royal W. Craig

(57) ABSTRACT

The present invention provides a lacrosse stick head having at least one of a grooved frame member and an independent stop. The lacrosse stick head has grooved construction in the entirety or portions of its frame to provide lightness while retaining the strength and durability of the prior art lacrosse stick heads. The lacrosse stick head may include a double wall scoop (e.g., upper and lower rails) to provide lightness while retaining strength and durability without altering the effectiveness of picking up a ground ball. The independent ball stop is separated from the sidewalls in order to reduce weight.

23 Claims, 5 Drawing Sheets

U.S. PATENT DOCUMENTS

| | | | |
|---|---|---|---|
| 5,674,140 | A | 10/1997 | Tucker et al. |
| 5,935,026 | A | 8/1999 | Dill et al. |
| 5,938,550 | A | 8/1999 | Hexemer et al. |
| 5,957,791 | A | 9/1999 | Nichols et al. |
| 6,066,056 | A | 5/2000 | Morrow |
| 6,283,879 | B1 | 9/2001 | Eden et al. |
| RE37,894 | E | 10/2002 | MacNeil |
| 6,561,932 | B2 | 5/2003 | Morrow et al. |
| RE38,216 | E | 8/2003 | Morrow et al. |
| 6,676,547 | B1 | 1/2004 | Morrow et al. |
| 6,723,134 | B2 | 4/2004 | Tucker, Sr. |
| 6,852,047 | B2 | 2/2005 | Tucker, Sr. |
| 6,910,976 | B2 | 6/2005 | Tucker, Sr. |
| 6,923,739 | B2 | 8/2005 | Gait et al. |
| 6,926,628 | B2 | 8/2005 | Morrow et al. |
| 6,994,640 | B2 | 2/2006 | Morrow et al. |
| D521,579 | S * | 5/2006 | Quinn ..... D21/724 |
| 7,226,374 | B2 | 6/2007 | Morrow et al. |
| 7,357,739 | B2 | 4/2008 | Montano et al. |
| 2004/0002398 | A1 | 1/2004 | Morrow et al. |
| 2004/0072637 | A1 | 4/2004 | Morrow et al. |
| 2004/0116217 | A1 | 6/2004 | Morrow et al. |
| 2004/0180738 | A1 | 9/2004 | Morrow et al. |
| 2005/0064963 | A1 * | 3/2005 | Filice et al. ..... 473/513 |
| 2005/0215359 | A1 | 9/2005 | Gait |
| 2005/0215360 | A1 | 9/2005 | Gait |
| 2006/0160640 | A1 | 7/2006 | Rettberg |

* cited by examiner

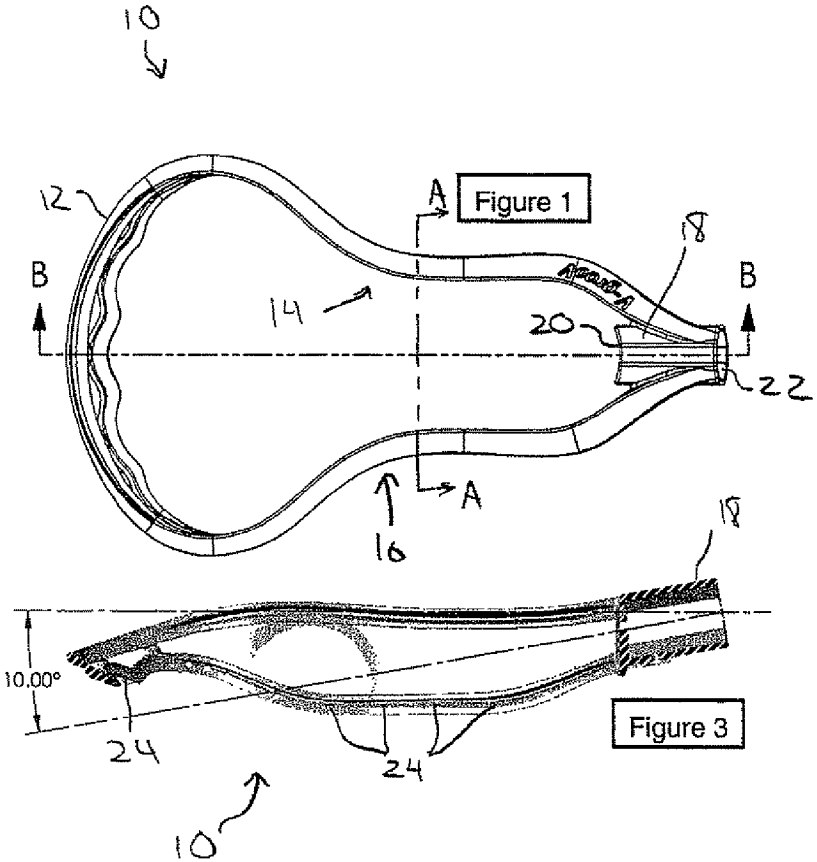
10
12
B
B
14
A
A
16
18
20
22
Figure 1
24
24
10.00°
Figure 3
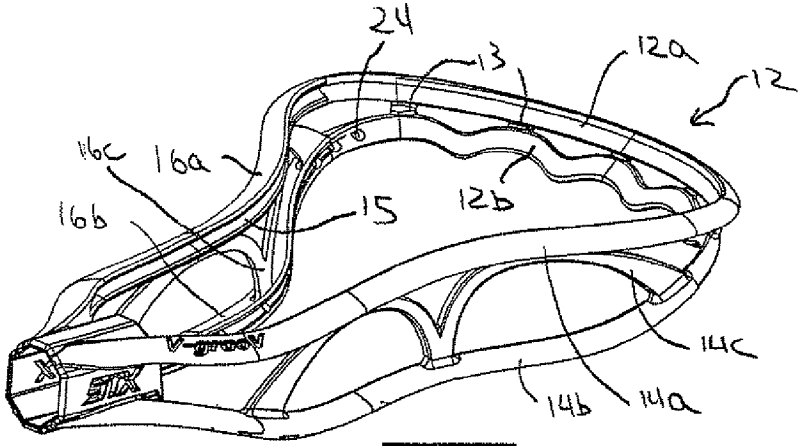
12
12a
12b
13
14a
14b
14c
15
16a
16b
16c
24
Figure 2
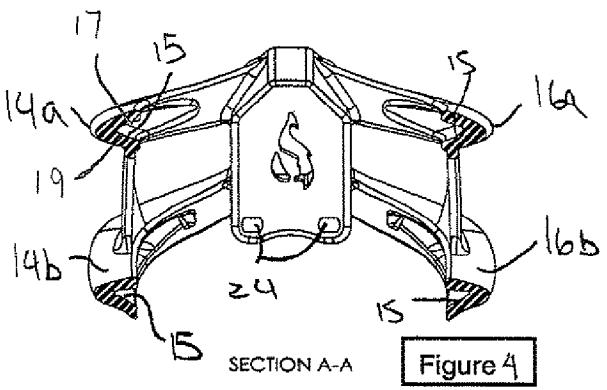
14a
14b
15
16a
16b
17
19
24
SECTION A-A
Figure 4

LACROSSE HEAD HAVING A GROOVED FRAME MEMBER AND INDEPENDENT STOP

This is a division of U.S. patent application Ser. No. 11/414,212, filed May 1, 2006 now U.S. Pat. No. 7,736,252, which claims the benefit of U.S. Provisional Application No. 60/676,312, filed May 2, 2005, which are herein incorporated by reference in their entirety.

BACKGROUND

1. Field of the Invention

The present invention relates generally to lacrosse sticks, and more particularly, to a lacrosse stick head having at least one of a grooved frame member and an independent stop.

2. Background of the Invention

Lacrosse players favor lacrosse stick heads that are lightweight, but strong and durable. Players also favor lacrosse heads that retain the ball in the pocket, enhance ball control, and dampen rebound and rattle.

SUMMARY OF THE INVENTION

An embodiment of the present invention provides a lacrosse stick head having at least one of a grooved frame member and an independent stop.

An embodiment of the present invention provides a lightweight lacrosse stick head having grooved construction in the entirety or portions of its frame to provide lightness while retaining the strength and durability of the prior art lacrosse stick heads.

In addition, an embodiment of the present invention provides a lacrosse head with a double wall scoop (e.g., upper and lower rails) to provide lightness while retaining strength and durability without altering its effectiveness in picking up a ground ball.

In addition, an embodiment of the present invention provides a lightweight lacrosse stick head with an independent ball stop that is separated from the sidewalls in order to reduce weight.

In addition, an embodiment of the present invention provides an extended socket that accommodates a shortened handle and ultimately increases the length of the head.

In addition, an embodiment of the present invention provides an extended socket that can trap the ball and prevent ball dislodgement.

In addition, an embodiment of the present invention provides a flat or convex ball stop that is constructed so that, in at least one implementation, the ball stop flexes or gives upon ball contact in order to dampen the ball and prevent ball rebound.

BRIEF DESCRIPTION OF THE DRAWINGS

The above-mentioned and other features and advantages of this disclosure, and the manner of attaining them, will become more apparent and the disclosure itself will be better understood by reference to the following description taken in conjunction with the accompanying drawings, wherein:

FIG. 1 is a schematic diagram of a top view of an exemplary lacrosse head having a grooved frame member and an independent stop, according to an embodiment of the present invention;

FIG. 2 is a schematic diagram of a perspective view of an exemplary lacrosse head having a grooved frame member and an independent stop, according to an embodiment of the present invention;

FIG. 3 is a schematic diagram of a cross-section taken along line B-B in FIG. 1 of an exemplary lacrosse head having a grooved frame member and an independent stop, according to an embodiment of the present invention;

FIG. 4 is a schematic diagram of a cross-section taken along line A-A in FIG. 1 of an exemplary lacrosse head having a grooved frame member and an independent stop, according to an embodiment of the present invention;

Figure 5:
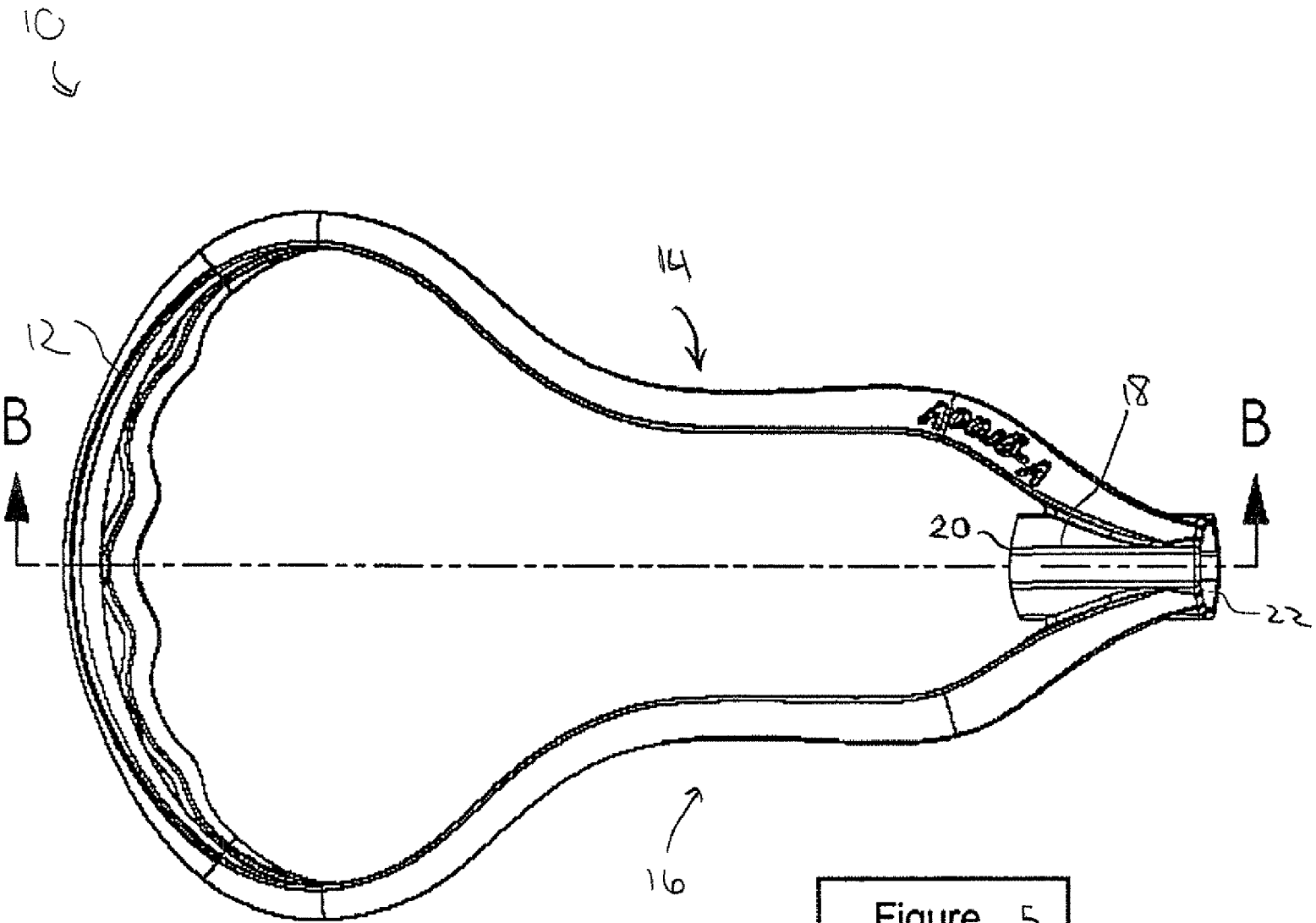
FIG. 5 is a schematic diagram of an exemplary lacrosse head having a grooved frame member and a convex independent stop, according to an embodiment of the present invention.

The present invention will be described with reference to the accompanying drawings. Corresponding reference characters indicate corresponding parts throughout the several views. The description as set out herein illustrates an arrangement of the invention and is not to be construed as limiting the scope of the disclosure in any manner.

DETAILED DESCRIPTION OF THE INVENTION

An embodiment of the lacrosse stick of the present invention comprises a handle (not shown) and a synthetic head 10. FIGS. 1-5 illustrate an exemplary lacrosse head 10 according to an embodiment of the present invention. The head 10 comprises a double rail scoop 12, right sidewall 14, left sidewall 16, and a throat section 18 that extends preferably both forwardly of the end of the sidewalls 14, 16 (i.e., toward scoop 12) and rearwardly of the end of the sidewalls 14, 16 (i.e., away from scoop 12). All or a portion of the rearwardly extending throat 18 can comprise a socket 22 for connection to a handle. In this embodiment, a stop member 20 serving as a ball rest sits at the forward end of the throat section 18 and is noncontiguous with or independent of the sidewalls 14, 16. The handle fits into the extended socket 22 and may or may not abut the stop member 20. A web or pocket (not shown) is attached to the ball retaining side of the head 10 through string holes 24 in the sidewalls 14, 16, scoop 12, and from the throat 18.

An embodiment of the present invention incorporates grooved construction, which comprises, for example, a sidewall rail 14*a* that includes two or more intersecting surfaces that create an enclosed hollow space, groove, or cavity 15 (all of which terms may be used interchangeably herein without exclusion) of varying shapes and geometry near the point where the surfaces join, as shown in FIG. 4. The groove 15 can be located in any or all of the sidewall rails, including, for example, the right sidewall top rail 14*a*, the right sidewall bottom rail 14*b*, the left sidewall top rail 16*a*, and the left sidewall bottom rail 16*b*. In lacrosse heads having a single sidewall rail or more than two sidewall rails, it is appreciated that any of the rails may include a groove 15 in accordance with the present invention.

Figure 9:
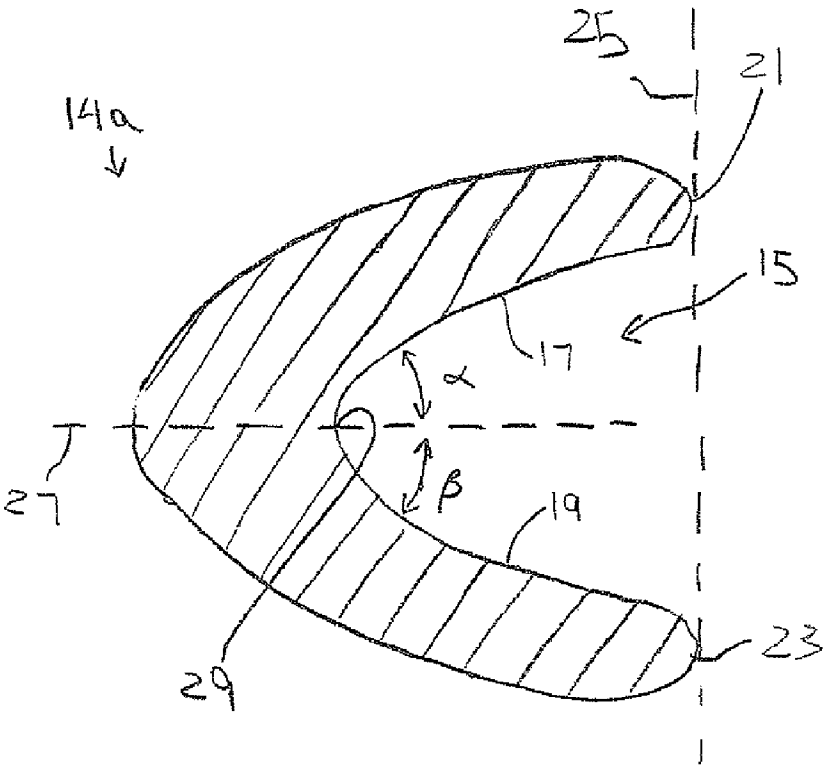
FIG. 9 is a schematic diagram of a detailed cross-sectional view of a sidewall rail having a groove, according to an embodiment of the present invention.

As shown in the embodiment of FIG. 9, a rail 14*a* can comprise an upper intersecting surface 17 having an edge 21 and a lower intersecting surface 19 having an edge 23. In the perspective of the cross-section in FIG. 9, the upper surface 17 of rail 14*a* is shown as having a positive angular inclination α with respect to a horizontal axis 27 while the lower surface 19 is shown as having a negative angular inclination β with respect to a horizontal axis 27. Due to the inclinations of the surfaces 17, 19, a point of intersection 29 is formed, thereby creating a hollow space 15 (or groove 15) near the point of intersection 29. As shown in FIG. 9, the edge 21 of the upper surface 17 and the edge 23 of the lower surface 19 are preferably configured to extend to a common vertical axis 25. Thus, the surfaces 17, 19 may be said to generally oppose each other in a direction from the ball receiving side to the ball retaining side of the lacrosse head 10. Two intersecting surfaces could oppose each other, for example, by having an angle between them of less than 90 degrees. The edges 21, 23 of the intersecting surfaces 17, 19 may be rounded, as shown in FIG. 9, or flat, as shown in FIGS. 2 and 4.

Although described above with respect to rail 14*a* having a groove 15 with a hollow space opening toward the inside (or pocket side) of the sidewall 14, one skilled in the art will appreciate that the groove 15 of rail 14*a* may open toward the external side of the sidewall 14. In such a case, the upper intersecting surface 17 may have a negative angular inclination with respect to a horizontal axis and the lower intersecting surface 19 may have a positive angular inclination with respect to a horizontal notional plane. These inclinations would naturally result in a groove 15 having a hollow space opening toward the external side (left side, in FIG. 4) of the sidewall and would be a mirror image (with respect to a vertical axis) of the cross-section of the rail 14*a* shown in FIG. 4.

In an embodiment, the width of the grooved rails 14*a*, 14*b*, 16*a*, 16*b* as viewed in the cross-section of FIG. 4 may be greater than their height, which may improve strength and weight characteristics in accordance with an objective of the present invention. As viewed in FIG. 4, the width of the rail 14*a*, for example, may be defined as the thickness of the rail 14*a* measured from the edge of the pocket side of the rail 14*a* to the edge of the external side of the rail 14*a*. The height of the rail 14*a*, for example, may be defined as the thickness of the rail 14*a* measured from the edge of the ball receiving side of the rail to the edge of the ball retaining side of the rail.

One skilled in the art will also appreciate that the intersecting surfaces 17, 19 may be oriented such that the groove 15 has a hollow space opening in the direction of the ball receiving side of the lacrosse head (i.e., upward in FIG. 4) or in the direction of the ball retaining side of the lacrosse head (i.e., downward in FIG. 4). Each of the rails 14*b*, 16*a*, 16*b* may be configured to have a groove 15 with a hollow space opening toward any of the above-described directions or variants thereof (e.g., a groove 15 may also have a hollow space opening toward an angular direction with respect to horizontal or vertical notional planes).

A groove 15 can be, for example, v-shaped, c-shaped, square-shaped, or any other suitable shape. A groove 15 of any shape may have a hollow space opening toward the inside (pocket side) of the sidewall or the hollow space of the groove 15 may open toward the external side of the sidewall, as described above. The groove 15 may or may not be the same shape as the outer surface (e.g., the outer surface may comprise three surfaces that form a c-shape while the groove 15 is configured to have a v-shape). The groove 15 may take the form of a cavity and be completely enclosed by the outer surface, or the groove 15 may have one or more exposed surfaces. In the configuration wherein the groove is completely enclosed, any of the above-described configurations of direction of opening and shape may be utilized with the addition of a further surface either completely or partially enclosing the hollow space of the groove 15. The groove 15 may have one or more struts that connect the intersecting surfaces in order to increase strength. Preferably, at least part of the inside surfaces of the intersecting surfaces that form the groove 15 are exposed. The longitudinal axis of groove 15 also preferably runs along a sidewall generally in the longitudinal direction of the sidewall.

Unexpectedly, the groove 15 reduces weight without compromising the strength of the lacrosse head 10. By changing the shape, dimension, depth, and placement of the groove 15 and/or the thickness of the frame member (e.g., wall 14, 16) housing the groove 15, one is able to configure the head 10 to prevent breakage and strategically place flex points along the frame. In addition, the walls 14, 16 may not have uniform strength and/or stiffness moduli. The depth and shape of the groove 15 affect the strength and durability of the head 10. Measured vertically, a frame part that forms the groove 15 may range in height from 0.06 to 2.00 inches.

The open scoop 12 can be constructed with double walls or rails, including a top scoop rail 12*a* and a bottom scoop rail 12*b*, having a substantial area of the scoop 12 open so as to reduce weight and enhance aerodynamics. In a preferred embodiment, the entire scoop area may be open in the range of 10%-80%, for example. The two rails 12*a*, 12*b* of the scoop may preferably be configured so as to be extensions of the sidewall rails so that top scoop rail 12*a* may be an extension of and connect upper sidewall rails 14*a* and 16*a* and bottom scoop rail 12*b* may be an extension of and connect bottom sidewall rails 14*b* and 16*b*. The top scoop rail 12*a* and the bottom scoop rail 12*b* are preferably substantially coplanar. For strength and durability, the scoop walls may be connected at various locations by struts or connectors 13 of varying thickness and shape. The struts may be of the same or different material as the scoop walls. The scoop 12 construction enables smooth ground ball pickups while retaining the required strength and durability of a conventional solid scoop. Stringing may be attached through the open sections of the scoop, or through additional stringing holes that are added into the bottom scoop rail 12*b* or from tabs adjoining the bottom scoop rail 12*b*.

Figure 6:
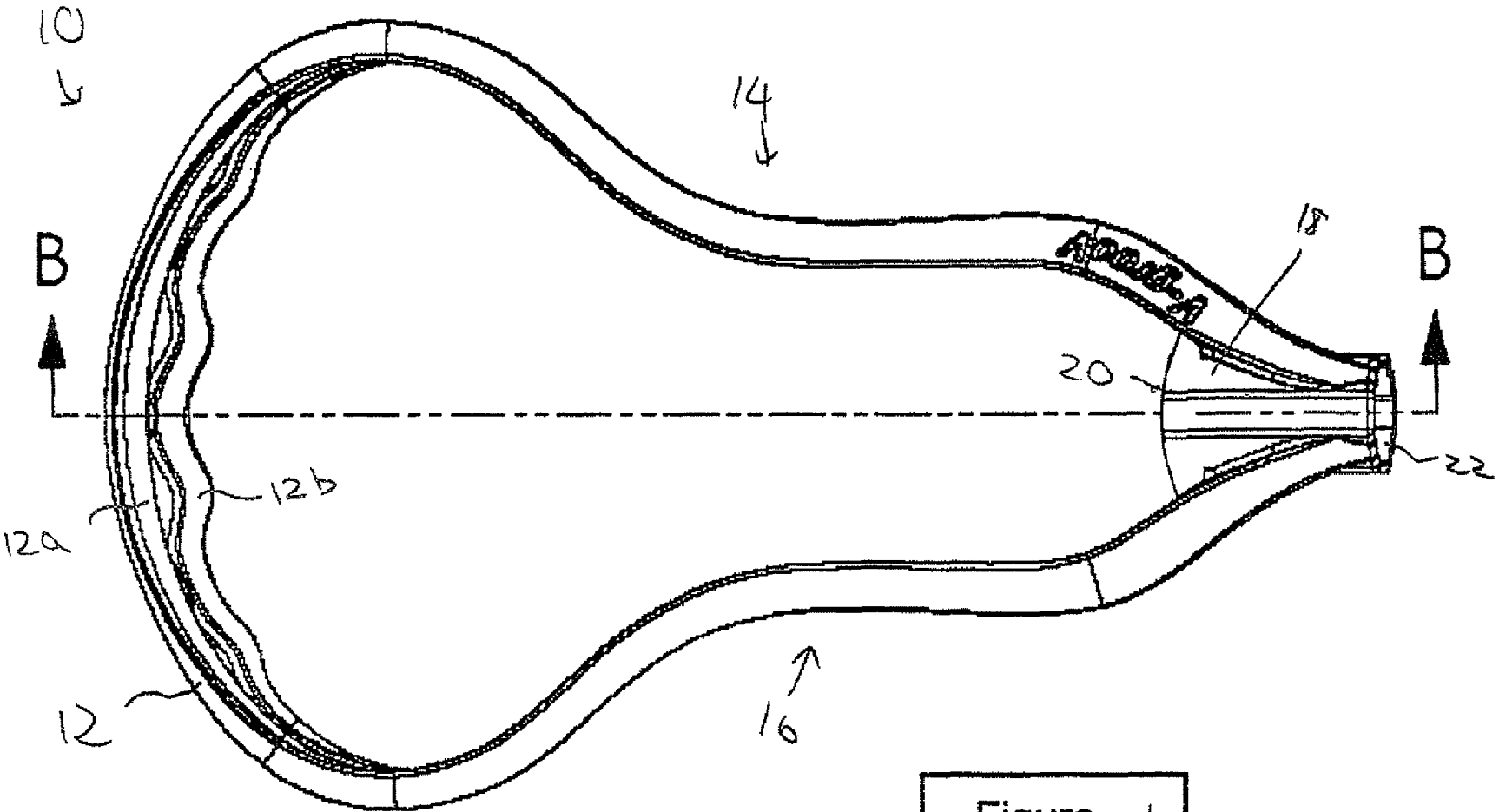
FIG. 6 is a schematic diagram of an exemplary lacrosse head having a grooved frame member and a convex stop, according to an embodiment of the present invention.
Figure 7:
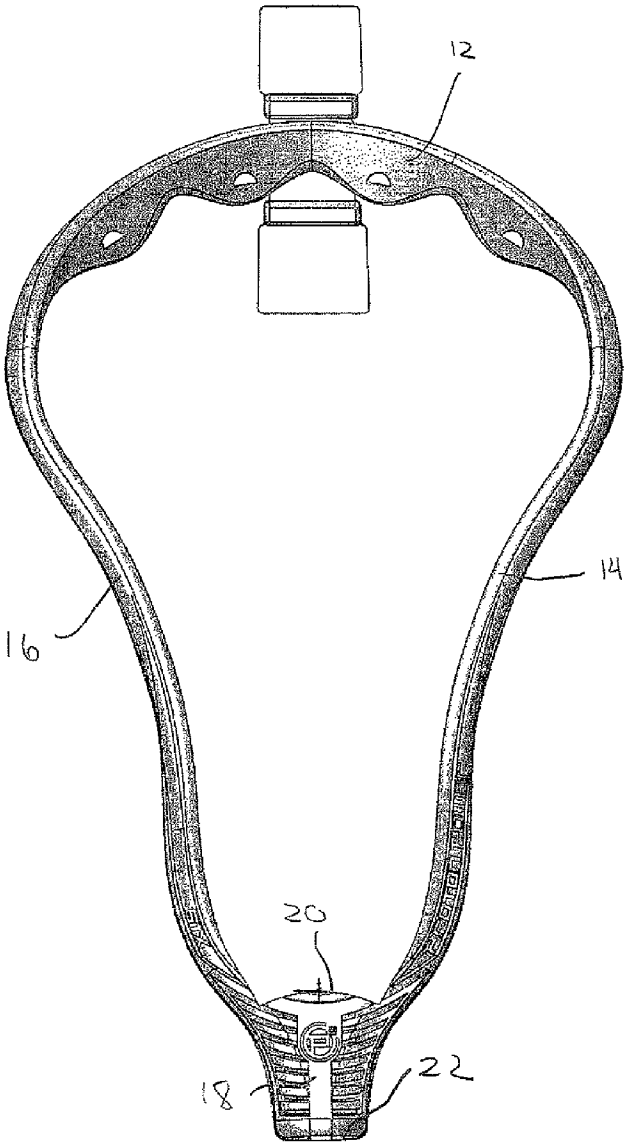
FIG. 7 is a schematic diagram of an exemplary lacrosse head having a convex stop, according to an embodiment of the present invention.

In an embodiment of the present invention, the ball stop 20 is separated from the sidewalls 14, 16 in order to reduce weight. When viewed from a plan view, the surface of the ball stop 20 may range from a concave to a convex surface, and can also be flat. As examples, FIG. 1 illustrates a concave ball stop, while FIGS. 5-7 illustrate convex stops. In addition to the ball stop 20 being separated from and non-contiguous with the sidewalls 14, 16, it may also be separated from the socket 22 and be of varying shapes and sizes and of hollow, semi-hollow or solid construction. For example, the surface of the ball stop 20 may be grooved itself (e.g., either arcuate or non-arcuate), when viewed from a plan view.

Figure 8:
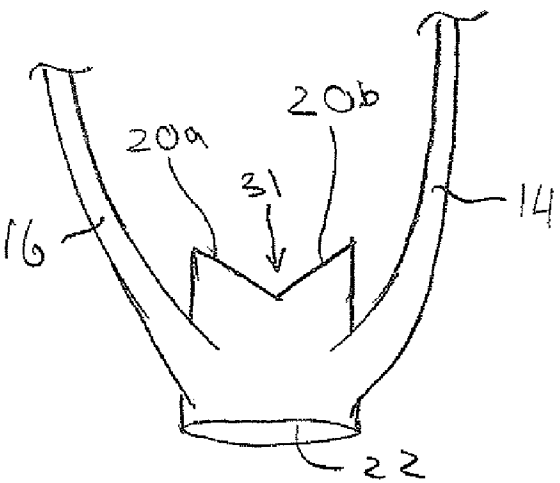
FIG. 8 is a schematic diagram of an exemplary lacrosse head having a grooved stop, according to an embodiment of the present invention.

In the grooved configuration of the ball stop 20, as shown in FIG. 8, the ball stop may have surfaces 20*a*, 20*b* that intersect to create a hollow space 31, as described above with respect to the rails of the sidewalls. In this case, however, the surfaces 20*a*, 20*b* may have a larger area than the surfaces of the sidewalls and may intersect at a greater (more obtuse) angle in order to accommodate a ball (although in some embodiments the angle of intersection of the surfaces of the sidewall rails may be greater than or equal to the angle of intersection of the surfaces of the ball stop 20). As such, the groove in the ball stop 20 may extend from the ball receiving side of the lacrosse head 10 to the ball retaining side of the lacrosse head 10.

By moving the location of the stop 20 towards the scoop 12 and maintaining the fixation location for the handle, the length of the head 10 is increased (to meet NCAA crosse dimension rules), which allows for a decrease in the length of the handle (yet still complying with NCAA stick dimensions). Players deem it advantageous to play with the shortest handles allowable under lacrosse game rules. Since most plastics are lighter than metal, by reducing the length of the handle, the overall weight of the stick is reduced and playability is improved. In addition, by lengthening the head 10, the length of the leathers on a traditionally strung head is increased, which can increase the flex of the pocket in a tightly strung women's lacrosse head. Pocket flex can improve playability by making heads easier to catch with.

A convex stop 20 can be beneficial because, with the correct material thickness, the convex stop 20 can act like a bubble and flex or give when the ball makes contact with it. This flexibility aids in securing the ball in the pocket. In addition, by moving the stop 20 forward of the stringing holes 24 in the throat section 18 of head 10, the ball can be secured under the ball stop 20. The stop 20 can therefore prevent dislodgement of the ball and impede the release of the ball when the stick is checked, a desirable feature in modern lacrosse sticks.

An embodiment of the present invention also provides a lacrosse stick having a downwardly canted handle and an upwardly canted head 10, as best shown in FIG. 3, and as is more fully described in the pending U.S. patent application Ser. No. 11/073,750 filed Mar. 8, 2005, which is herein incorporated by reference in its entirety.

Examples of suitable materials for a lacrosse head 10 according to the present invention include nylon, composite materials, elastomers, metal, urethane, polycarbonate, polyethylene, polypropylene, polyketone, polybutylene terephalate, acetals Delrin™ by DuPont), acrylonitrile-butadiene-styrene (ABS), acrylic, acrylic-styrene-acrylonitrile (ASA), alcryn (partially crosslinked halogenated polyolefin alloy), styrene-butadiene-styrene, styrene-ethylene-butylene styrene, thermoplastic olefinic (TPO), thermoplastic vulcanizate (TPV), ethylene-propylene rubber (EPDM), and polyvinyl chloride (PVC).

The foregoing disclosure of the preferred embodiments of the present invention has been presented for purposes of illustration and description. It is not intended to be exhaustive or to limit the invention to the precise forms disclosed. Many variations and modifications of the embodiments described herein will be apparent to one of ordinary skill in the art in light of the above disclosure. The scope of the invention is to be defined only by the claims, and by their equivalents.

What is claimed is:

1. A lacrosse head, comprising:

(a) a throat portion comprising a stop member at a forward end and a socket portion at a rearward end;

(b) a scoop portion;

(c) a first sidewall having a top rail and a bottom rail that extend generally from the throat portion to the scoop portion;

(d) a second sidewall having a top rail and a bottom rail that extend generally from the throat portion to the scoop portion; and (e) a central longitudinal axis extending through the mid-point of the scoop portion and the mid-point of the throat portion;

(f) wherein the stop member is formed integrally with the throat portion, and wherein the forward-most point on the stop member that lies on the central longitudinal axis extends forwardly of an end of at least one of said top rail of either the first or second sidewall and said bottom rail of either the first or second sidewall.

2. The lacrosse head of claim 1, wherein the stop member has a concave surface.

3. The lacrosse head of claim 1, wherein the stop member has a convex surface.

4. The lacrosse head of claim 1, wherein the stop member has a grooved surface.

5. The lacrosse head of claim 1, wherein the stop member has a textured surface.

6. The lacrosse head of claim 1, wherein the stop member has a generally flat surface.

7. The lacrosse head of claim 1, further comprising an attachment member attached to the stop member, the attachment member being formed of a material different from that of the stop member.

8. The lacrosse head of claim 1, further comprising an attachment member attached to the stop member, the attachment member being formed of a more resilient material than that of the stop member.

9. The lacrosse head of claim 1, the throat portion further comprising a socket for receiving a shaft, and wherein the stop member is separated from the socket and is of hollow or semi-hollow construction.

10. A lacrosse head, comprising:

(a) a throat portion comprising a stop member at a forward end and a socket portion at a rearward end;

(b) a scoop portion;

(c) a first sidewall having a top rail and a bottom rail that extend generally from the throat portion to the scoop portion; and (d) a second sidewall having a top rail and a bottom rail that extend generally from the throat portion to the scoop portion; and (e) a central longitudinal axis extending through the mid-point of the scoop portion and the mid-point of the throat portion;

(f) wherein the stop member comprises a ball-contacting surface having a point lying on the central longitudinal axis, the point being disposed forwardly of surfaces adjacent to the stop member on the interior side of the lacrosse head, the stop member and the adjacent surfaces being formed of the same material.

11. The lacrosse head of claim 10, further comprising a first rearwardly extending notch disposed between the ball-contacting surface and the first sidewall and a second rearwardly extending notch disposed between the ball-contacting surface and the second sidewall.

12. The lacrosse head of claim 11, wherein the first notch is formed by an interior surface of the first sidewall and a surface of the throat portion, and the second notch is formed by an interior surface of the second sidewall and a surface of the throat portion.

13. The lacrosse head of claim 10, wherein the stop member is separated from and non-contiguous with the first and second sidewalls.

14. The lacrosse head of claim 10, the throat portion further comprising a socket for receiving a shaft, and wherein the stop member is separated from the socket and is of hollow or semi-hollow construction.

15. The lacrosse head of claim 10, wherein the ball-contacting surface is concave.

16. The lacrosse head of claim 10, wherein the ball-contacting surface is convex.

17. The lacrosse head of claim 10, wherein the stop member has a hollow or semi-hollow construction and the ball-contacting surface is configured to flex or give when a lacrosse ball makes contact with it.

18. The lacrosse head of claim 10, wherein the stop member is grooved.

19. The lacrosse head of claim 18, wherein the grooved stop member is formed of two surfaces that intersect to create a hollow space, the groove being formed at the intersection of the two surfaces and extending from the ball receiving side of the lacrosse head to the ball retaining side of the lacrosse head.

20. The lacrosse head of claim 10, wherein the ball-contacting surface is generally flat.

21. The lacrosse head of claim 10, further comprising an attachment member attached to the stop member, the attachment member being formed of a material different from that of the stop member.

22. The lacrosse head of claim 10, further comprising an attachment member attached to the stop member, the attachment member being formed of a more resilient material than that of the stop member.

23. The lacrosse head of claim 10, wherein the socket portion is configured to receive a shaft such that a received end of the shaft extends forwardly of the rearward ends of at least one of said top rail and said bottom rail.

* * * * *